US007903992B2

(12) United States Patent
Sakabe

(10) Patent No.: US 7,903,992 B2
(45) Date of Patent: Mar. 8, 2011

(54) IMAGE FORMING APPARATUS AND METHOD FOR DISCRIMINATING WHETHER A DOCUMENT IS IN FULL COLOR OR MONOCHROMATIC COLOR

(75) Inventor: Tomokazu Sakabe, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 468 days.

(21) Appl. No.: 12/041,003

(22) Filed: Mar. 3, 2008

(65) Prior Publication Data

US 2008/0226328 A1 Sep. 18, 2008

(30) Foreign Application Priority Data

Mar. 15, 2007 (JP) ..... 2007-67326

(51) Int. Cl.
*G03G 15/00* (2006.01)

(52) U.S. Cl. ..... 399/82

(58) Field of Classification Search ..... 399/82, 399/298, 302, 308, 300, 66, 299, 306
See application file for complete search history.

(56) References Cited

U.S. PATENT DOCUMENTS

| | | | | |
|---|---|---|---|---|
| 7,349,658 | B2 * | 3/2008 | Ogata et al. | 399/299 |
| 2006/0133843 | A1 * | 6/2006 | Sugaya | 399/82 |
| 2009/0252517 | A1 * | 10/2009 | Tachiki et al. | 399/66 |

FOREIGN PATENT DOCUMENTS

| | | |
|---|---|---|
| JP | 2003-207970 | 7/2003 |
| JP | 2003-237191 | 8/2003 |
| JP | 2005-111770 | 4/2004 |

OTHER PUBLICATIONS

Translation of JP2003-207970A, Jul. 25, 2003; translation of JP2005-111770A, Apr. 8, 2005.*

* cited by examiner

*Primary Examiner*—Quana M Grainger
(74) *Attorney, Agent, or Firm*—Turocy & Watson, LLP

(57) ABSTRACT

An image forming apparatus for judging, on the basis of image information, whether an image to be printed is a monochromatic image or a full color image, deciding, at the beginning of a job, a separation mode for the monochromatic image and a contact mode for the full color image, deciding, after a predetermined condition is satisfied on the basis of previous result information of the concerned job, the contact mode for both monochromatic images and full color images, and printing the images in the decided mode.

18 Claims, 6 Drawing Sheets

IMAGE FORMING APPARATUS AND METHOD FOR DISCRIMINATING WHETHER A DOCUMENT IS IN FULL COLOR OR MONOCHROMATIC COLOR

CROSS-REFERENCE TO RELATED APPLICATION

This application is based upon and claims the benefit of priority from the prior Japanese Patent Application No. 2007-067326 filed on Mar. 15, 2007, the entire contents of which are incorporated herein by reference.

BACKGROUND

1. Field of the Invention

The present invention relates to an image forming apparatus having an ACS (Auto Color Selection) mode for discriminating automatically whether a read document is in full color or monochromatic color and processing an image, and an image forming method.

2. Description of the Related Art

In a four-each tandem type image forming apparatus, image forming units composed of a photosensitive drum and a developing device are prepared for each of four colors such as yellow, magenta, cyan and black and are arranged along an intermediate transferring belt formed on an endless loop. Images in each color formed by each image forming unit are superimposed on the intermediate transferring belt, thus a full color image is formed. When performing monochrome print by the four-each tandem type image forming apparatus, either of the separation mode and contact mode is used.

In the separation mode, if only the black image forming unit is operated, the printing operation can be performed, so that the image forming units of the other three colors of yellow, magenta and cyan are stopped, and the three image forming units are separated from the intermediate transferring belt, thus the monochrome print is performed. In the contact mode, the image forming units of all the four colors including the image forming units of three colors which are not used actually for printing are kept in operation, are permitted to make contact with the intermediate transferring belt, thereby perform the monochrome print. Therefore, the image forming units of yellow, magenta and cyan perform the operation without performing an actual print. Further, at time of full color print, the image forming units of all the four colors are operated and similarly to the contact mode aforementioned, the image forming units of all the four colors make contact with the intermediate transferring belt, thereby performing the full color print.

At time of monochrome print, when printing in the separation mode, in a print job including both the full color print and monochrome print, the switching operation of the contact mode and separation mode is necessary. However, the switching operation cannot be performed instantaneously, and the switching requires a lot of time, so that continuous print cannot be performed, and the print performance is lowered. When printing in the contact mode at time of the monochrome print, since both the full color print and monochrome print are performed in the contact mode, no switching time is generated. However, in the contact mode, a problem arises that the photosensitive drums of yellow, magenta and cyan which do not print actually progress in wear or the developer progresses in deterioration due to charging.

To solve the two problems concerning the aforementioned print performance and apparatus life, an art of switching and using the contact mode and separation mode at time of the monochrome print is proposed. In the art described in Japanese Patent Application Publication No. 2003-237191, at time of the monochrome print, when the next image is monochromatic, it is printed in the separation mode. Further, the art generates a pattern with the information of the three pages of the preceding image, the image to be printed, and the next image and judges which is applicable, the separation mode or contact mode.

However, in the art described in Japanese Patent Application Publication No. 2003-237191, only images of the preceding and subsequent one page are taken into account at maximum and the performance required in the previous print is not taken into account. Therefore, as a whole, there are possibilities of a reduction in the performance.

SUMMARY

An object of the present invention is to provide an image forming apparatus and an image forming method for avoiding a reduction in the apparatus life and improving the print performance.

According to the embodiments of the present invention, there is provided an image forming apparatus including a separation mode for permitting a transfer medium, at time of monochrome print, to make contact with only a monochromatic image forming unit and separating the transfer medium from a plurality of remaining image forming units and a contact mode for permitting the transfer medium to make contact with all the plurality of image forming units and enabling the modes to be switched, comprising judging means for judging, on the basis of image information, whether an image to be printed is a monochromatic image or a full color image; operation mode deciding means for deciding which is used to print the image, the contact mode or the separation mode; and printing means for printing the image in the decided mode, wherein the operation mode deciding means, at the beginning of a job, decides the separation mode for the monochromatic image and the contact mode for the full color image and after a predetermined condition is satisfied on the basis of previous result information of the job, decides the contact mode for both monochromatic images and full color images.

Further, according to the embodiments of the present invention, there is provided an image forming method for an image forming apparatus including a separation mode for permitting, at time of monochrome print, a monochromatic image forming unit to make contact with a transfer medium and permitting image forming units of other colors to separate from the transfer medium to execute printing and a contact mode for permitting the image forming units of all the colors to make contact with the transfer medium to execute printing for enabling the aforementioned modes to be switched, comprising judging, on the basis of image information, whether an image to be printed is a monochromatic image or a full color image; deciding, at the beginning of a job, the separation mode for the monochromatic image and the contact mode for the full color image; deciding, after a predetermined condition is satisfied on the basis of the previous result information of the job, the contact mode for both monochromatic images and full color images; and printing the images in the decided mode.

Further, according to the embodiments of the present invention, there is provided an image forming apparatus including a separation mode to permit a transfer medium, at time of monochrome print, to make contact with only a monochromatic image forming unit and separating it from a plurality of remaining image forming units and a contact mode to permit the transfer medium to make contact with all the plurality of image forming units and enabling the aforementioned modes to be switched, comprising a judging unit configured to judge, on the basis of image information, whether an image to be printed is a monochromatic image or a full color image; an operation mode deciding unit configured to decide which is used to print the image, the contact mode or the separation mode; and a printing unit configured to print the image in the decided mode, wherein the operation mode deciding unit, at the beginning of a job, decides the separation mode for the monochromatic image and the contact mode for the full color image and after a predetermined condition is satisfied on the basis of the previous result information of the concerned job, decides the contact mode for both monochromatic images and full color images.

BRIEF DESCRIPTION OF THE DRAWINGS

DETAILED DESCRIPTION OF THE EMBODIMENTS (First embodiment) FIG. 1 is a drawing showing the constitution of the image forming apparatus of the first embodiment of the present invention. FIG. 1 shows the condition at time of printing in the contact mode. An image forming apparatus 10 includes an image reader unit 11, an image forming unit 12 and a sheet feeder unit 13.

Figure 1:
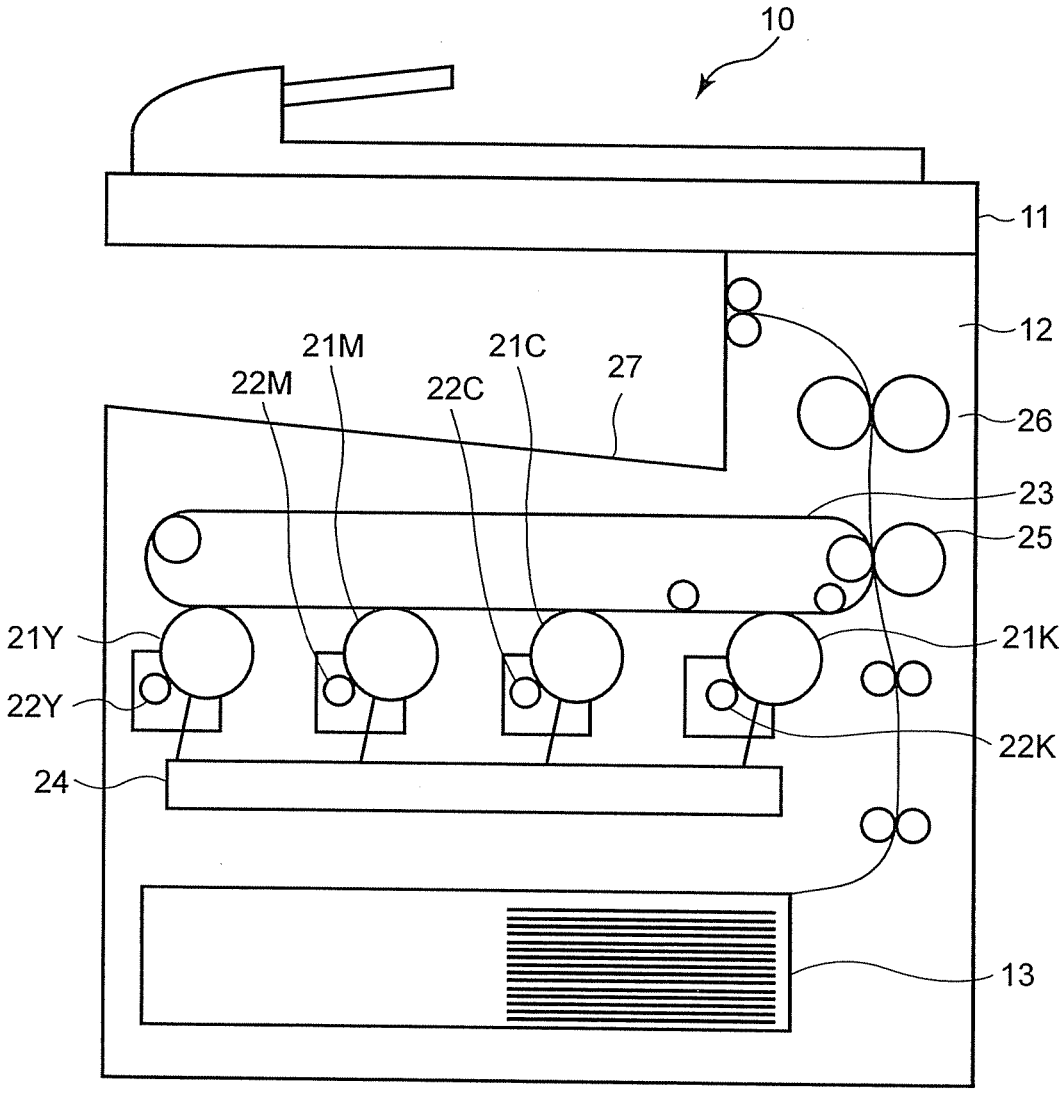
FIG. 1 is a schematic cross sectional view showing the constitution of the image forming apparatus of the first embodiment of the present invention.

The image reader unit 11 reads a document and generates image data. The image forming unit 12 forms an image from the image data and prints the image on a fed sheet. The sheet feeder unit 13 keeps sheets which are recording media and feeds the sheets to the image forming unit 12.

The image forming unit 12 adopts the 4-each tandem type image forming system. In the image forming unit 12, photosensitive drums 21Y (yellow), 21M (magenta), 21C (cyan) and 21K (black), developing devices 22Y (yellow), 22M (magenta), 22C (cyan) and 22K (black), an intermediate transferring belt 23 as a transfer medium, and a laser unit 24 are provided. The photosensitive drums 21Y, 21M, 21C and 21K and the developing devices 22Y, 22M, 22C and 22K compose respectively an image forming unit. The photosensitive drum 21K and developing device 22K compose, for example, a black image forming unit as a monochrome and form a monochromatic image. The photosensitive drums 21Y, 21M, 21C and 21K and the developing devices 22Y, 22M, 22C and 22K compose a plurality of image forming units and form a full color image.

Then, the operation of the image forming apparatus 10 will be explained. The intermediate transferring belt 23 moves at a fixed speed by a drive roller rotated by a motor (not shown). Firstly, a main charger (not shown) uniformly charges negatively the photosensitive drum 21Y. The charged photosensitive drum 21Y is exposed by the laser unit 24 in accordance with image information, thus an electrostatic latent image is formed thereon.

On the downstream side of the exposure by the laser unit 24, the developing device 22Y for storing an yellow (Y) developer (toner) is arranged. The electrostatic latent image on the photosensitive drum 21Y is developed reversely by the yellow toner and a toner image is formed on the photosensitive drum 21Y. On the downstream side of the developing device 22Y, transferring rollers (not shown) are arranged. To the transferring rollers, a bias voltage (+) with reverse polarity to the charged polarity of the toner is applied. As a result, the toner image on the photosensitive drum 21Y is transferred primarily onto the intermediate transferring belt 23 by a transfer electric field formed between the photosensitive drum 21Y and the transferring rollers.

The photosensitive drums 21M, 21C and 21K and the developing devices 22M, 22C and 22K execute a similar process. As a result, toner images of magenta (M), cyan (C) and black (K) formed on the photosensitive drums 21M, 21C and 21K are primarily transferred sequentially onto the intermediate transferring belt 23.

A sheet which is a transfer medium is sent from the sheet feeder unit 13 via sheet feed rollers to the image forming unit 12. At the end of the intermediate transferring belt 23, a transferring roller 25 is arranged. To the transferring roller 25, a bias voltage (+) with reverse polarity to the charged polarity of the toner is impressed. As a result, the toner image on the intermediate transferring belt 23 is transferred onto the sheet by a transfer electric field formed between the intermediate transferring belt 23 and the transferring roller 25. The sheet onto which the image is transferred is sent to a discharge sheet receiving portion 27 after the image is fixed by a fixing device 26 and is stored up.

When printing in the contact mode, as shown in FIG. 1, the photosensitive drums 21Y, 21M, 21C and 21K and developing devices 22Y, 22M, 22C and 22K make contact respectively with the intermediate transferring belt 23 and then form an image.

Figure 2:
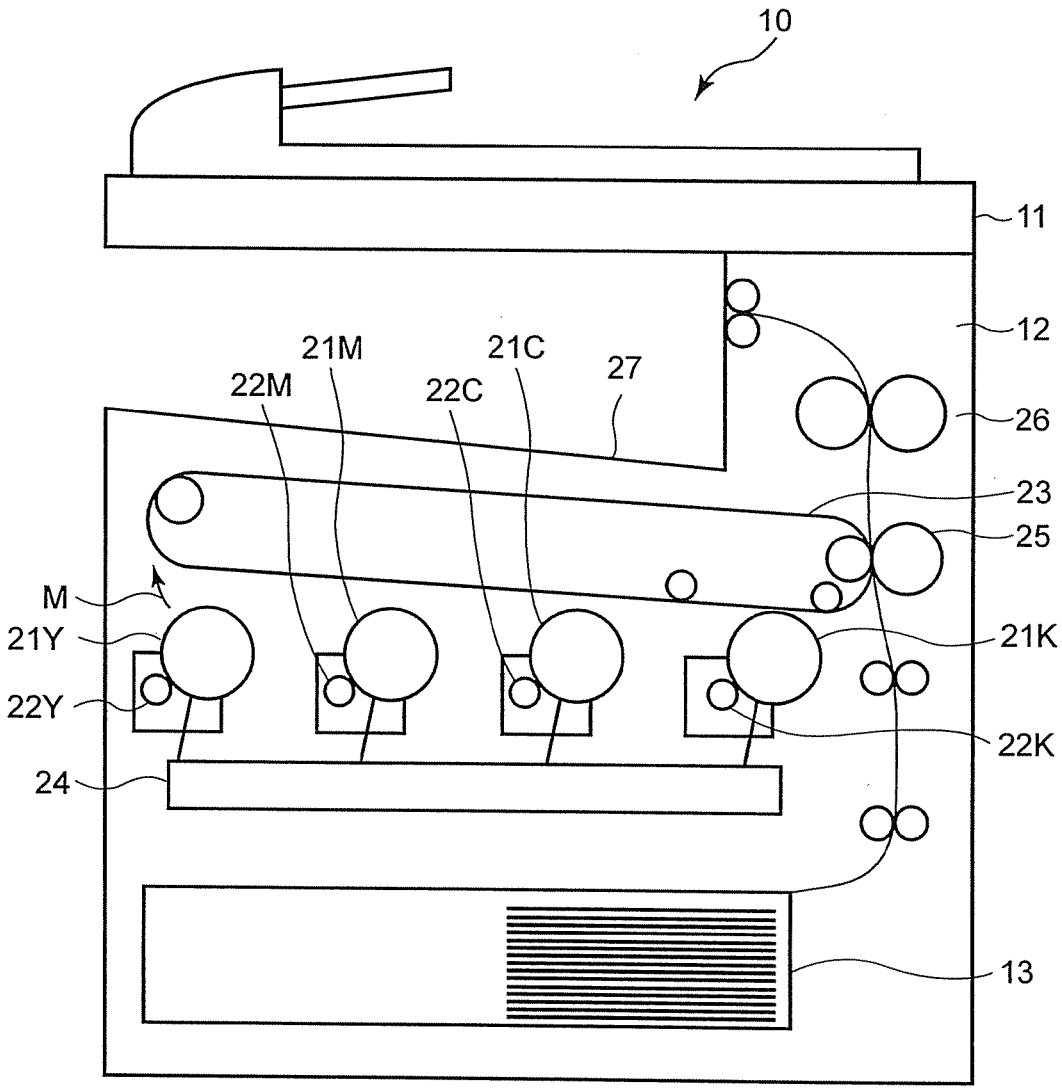
FIG. 2 is a schematic cross sectional view showing the condition of the image forming apparatus when printing in the separation mode.

FIG. 2 is a drawing showing the condition of the image forming apparatus 100 when printing in the separation mode. The intermediate transferring belt 23 moves in the direction showing by an arrow M to separate from the photosensitive drums 21Y, 21M and 21C which stop their operation. The developing devices 22Y, 22M and 22C also stop their operation. And, only the photosensitive drum 21K and developing device 22K make contact with the intermediate transferring belt 23 to transfer an image from the photosensitive drum 21K onto the intermediate transferring belt 23.

Further, when switching the state of the contact mode and the state of the separation mode, the stop or start operation of the photosensitive drum 21K and developing device 22K or the mechanical operation of separation from or contact with the intermediate transferring belt 23 occur. Therefore, the switching takes a lot of time and when switching frequently the contact mode and separation mode, the print performance is lowered.

Figure 3A:
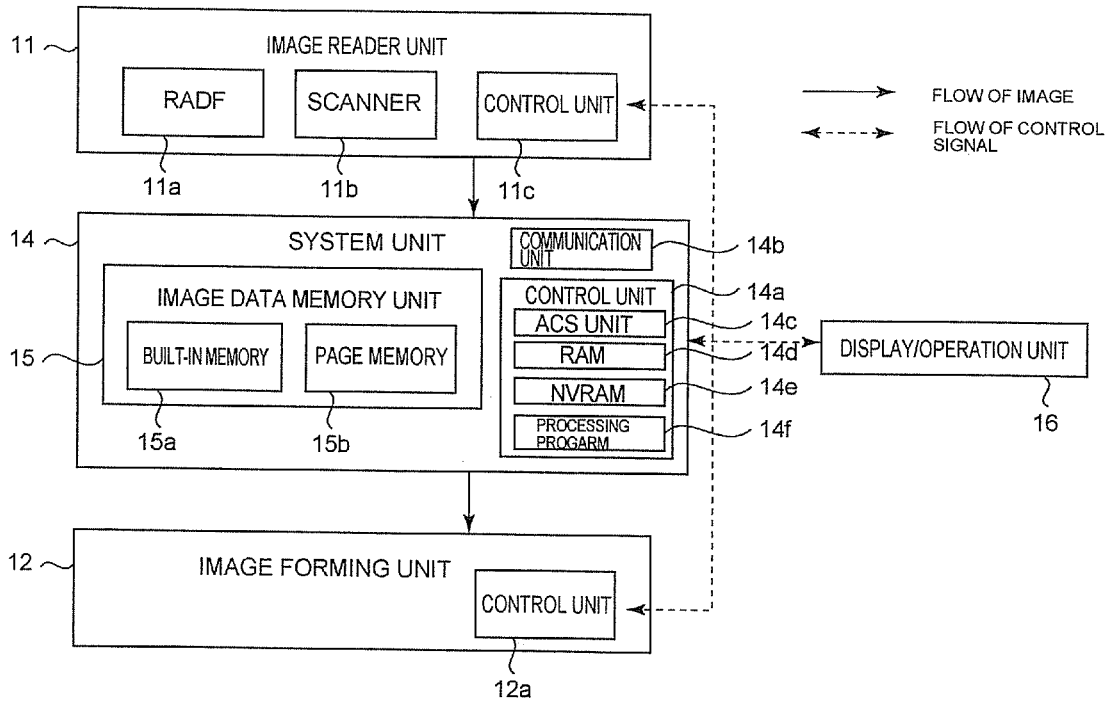
FIG. 3A is a block diagram showing the constitution relating to the data process of the image forming apparatus.

FIG. 3A is a block diagram showing the constitution relating to the data process of the image forming apparatus 10. In the image forming apparatus 10, the image reader unit 11, the image forming unit 12, a system unit 14 and a display/operation unit 16 are installed. The image reader unit 11 includes a reversible automatic document feeder 11*a*, a scanner 11*b* and a control unit 11*c*.

Figure 3B:
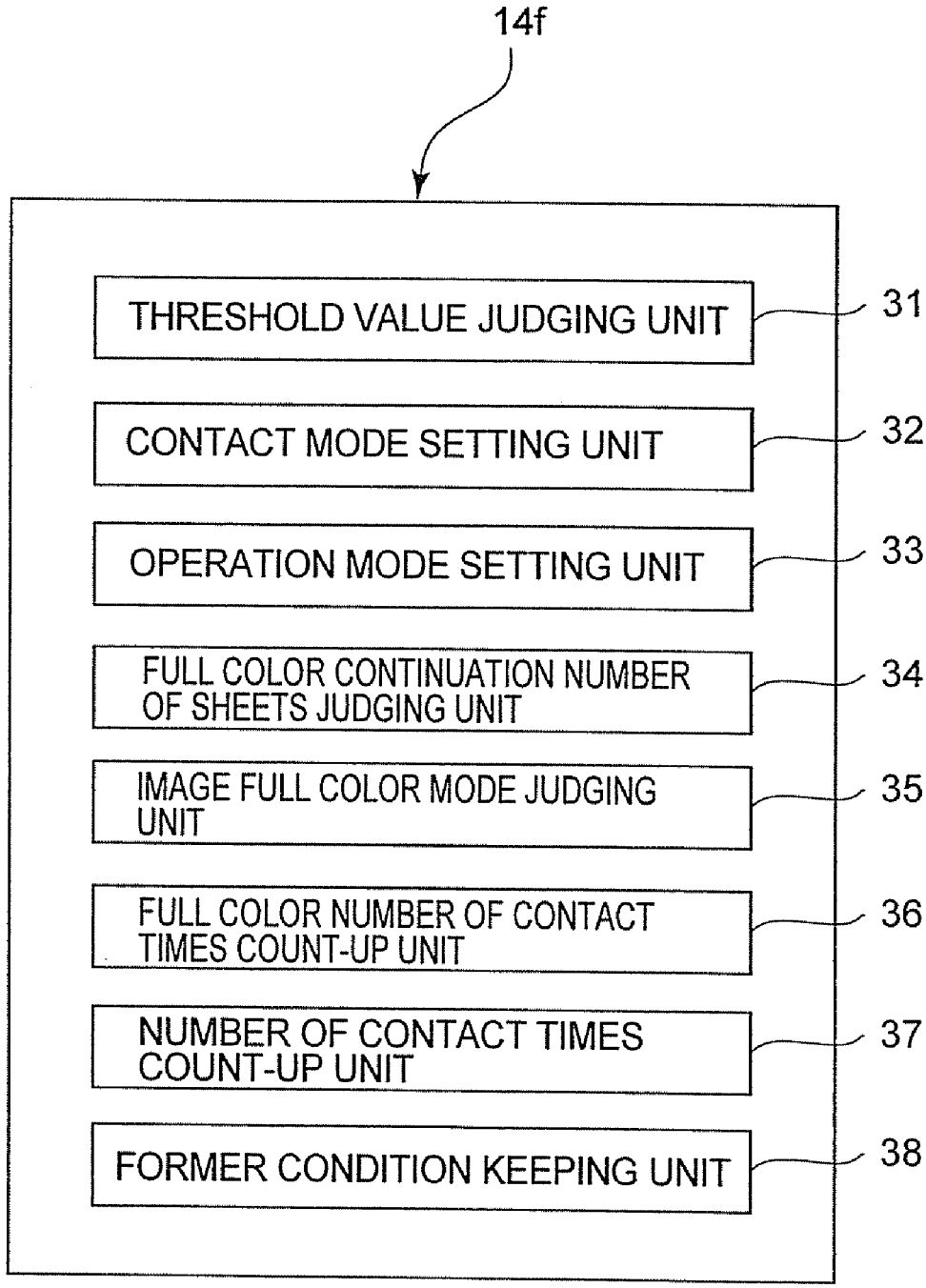
FIG. 3B is a block diagram showing the processing program in the block diagram in FIG. 3A.

The system unit 14 includes a control unit 14*a*, a communication unit 14*b* and an image data memory unit 15. And, the control unit 14*a* includes an ACS unit 14*c*, a RAM 14*d*, an NVRAM 14*e* and a processing program 14*f*. The image data memory unit 15 includes a built-in memory 15*a* and a page memory 15*b*. The processing program 14*f*, as shown in FIG. 3B, is composed of a threshold value judging unit 31, a contact mode setting unit 32, an operation mode setting unit 33, a full color continuation number of sheets judging unit 34, an image full color mode judging unit 35, a full color number of sheets count-up unit 36, a number of contact times count-up unit 37 and a former condition keeping unit 38.

The communication unit 14*b*, for example, via a communication line, receives an image from an external device not drawn. The image data memory unit 15 stores image data sent from the image reader unit 11 or external device in the built-in memory 15*a* or page memory 15*b*. The control unit 14*a* generalizes and controls the operation of each unit of the system unit 14. Further, the control unit 14*a* includes the ACS unit 14*c* for executing the ACS, the RAM (random access memory) 14*d* for storing data used for various processes and the NVRAM 14*e* which is a non-volatile memory for storing data even at time of power off without deleting it.

In the image forming unit 12, the control unit 12*a* is installed and controls the series of image forming operations mentioned above. The display/operation unit 16 transfers an instruction value inputted by an operator to the control units 11*c*, 12*a* and 14*a* and displays data transferred from the control units 11*c*, 12*a* and 14*a*.

Next, the operation of the image forming apparatus 10 will be explained. In the image reader unit 11, the scanner 11*b* reads a document put on the glass surface or fed from the reversible automatic document feeder 11*a* and outputs generated image data to the system unit 14. And, these operations are generalized and controlled by the control unit 11*c*.

The read image data, in the system unit 14, is stored in the page memory 15*b* of the image data memory unit 15. The stored image data, thereafter, is stored in the built-in memory 15*a* in the compressed or uncompressed state. In the ACS mode, the ACS unit 14*c* judges whether the image data is a full color image or a monochromatic image. The judgment result is stored together with the image data. And, the control unit 14*a* judges whether to form the concerned image in the separation mode or the contact mode.

In the printer print mode, the control unit 14*a* expands image data received via a network and stores it in the built-in memory 15*a*. In the ACS mode, the ACS unit 14*c* judges whether the image data is a full color image or a monochromatic image. The judgment result is stored together with the image data. And, the control unit 14*a* judges whether to form the concerned image in the separation mode or the contact mode.

The image data stored in the image data memory unit 15 is transferred to the image forming unit 12 and an image is formed on a memory medium such as a recording sheet. Further, the control unit 12*a*, according to the operation mode judged by the system unit 14, permits the image forming unit 12 to operate and form an image. Namely, in the contact mode, the control unit 12*a* forms an image in the state of the image forming apparatus 12 shown in FIG. 1 and in the separation mode, it forms an image in the state of the image forming apparatus 12 shown in FIG. 2.

Namely, in the contact mode, as shown in FIG. 1, the intermediate transferring belt 23 is in contact with all the photosensitive drums 21Y, 21M, 21C and 21K. Therefore, the toner images formed on the respective photosensitive drums 21Y, 21M, 21C and 21K are all superimposed and transferred onto the intermediate transferring belt 23.

In the separation mode, as shown in FIG. 2, the intermediate transferring belt 23 makes contact with only the photosensitive drum 21K and is separated from the remaining photosensitive drums 21Y, 21M and 21C. Therefore, a monochromatic toner image formed on the photosensitive drum 21K, for example, only a black toner image is transferred onto the intermediate transferring belt 23.

Next, the basic concept of the present invention will be explained. The print mode of the image forming apparatus 10 includes the three modes indicated below.

(1) Monochrome print mode: Mode of printing an image monochromatically in the separation mode
(2) Full color print mode: Mode of printing an image in the contact mode
(3) ACS print mode: The ACS unit 14*c* judges whether an image is monochromatic or full color, and when it is monochromatic, the image is printed monochromatically in the separation mode, and when it is full color, the image is printed in the contact mode.

In this embodiment, when printing an image in the ACS print mode, the operation mode is decided as indicated below. Generally, at time of the monochrome print, it is operated in the separation mode, so that expendables are prevented from shortened in the life span. However, in a situation that it is judged that continuation of printing in the separation mode results in lowering in the performance, the separation mode is switched to the contact mode. Switching to the contact mode is available to the case that in the coming printing, it is predicted that operation mode switching occurs and the case that it is predicted that in the future, printing of a full color image is continued.

When explaining it concretely, in this embodiment, when either of the two conditions indicated below is satisfied, that is, when the OR condition is satisfied, the operation mode at time of the monochrome print is switched.

Condition 1: Case that in the same job, the previous number of switching times from the separation mode to the contact mode is more than a predetermined value Condition 2: Case that in the same job, the full color continuation number of print sheets is more than a predetermined value Condition 1 will be explained. When the mode is switched (from the separation mode to the contact mode), it takes a lot of time and the performance is lowered. Therefore, the switching is restricted, thus the performance is improved. When the number of times of switching the mode is more than a predetermined number of times, it is predicted that monochromatic images and full color images are mixed more than a fixed number. Namely, hereafter, it can be predicted that not only monochromatic pages are used. Therefore, the mode is switched to the contact mode, thus to improve the performance is given priority. When the number of times of decision which is a reference value is made settable, even in a job that only the first sheet is a full color image, optimum control is available.

Condition 2 will be explained. For a job that full color print is performed continuously for a plurality of sheets, it can be predicted that the rate of full color pages in the job is high and the rate of monochromatic pages therein is low. Therefore, rather than putting a lot of time in switching to the separation mode for a small number of times of monochrome print, improvement of the performance in the contact mode is given priority. Further, when the number of times of monochrome print is small, due to the cause of life span deterioration by the idle time generated at time of mode switching, the effect of the life priority in the contact mode is decreased and it can be predicted that the original meaning may be lost, so that improvement of the performance is given priority. When the number of continuous sheets which is a reference value is made settable, even for a job that only several monochromatic sheets are inserted between full color sheets, optimum control is available.

Hereinafter, according to the basic concept aforementioned, the procedures when printing an image stored in the built-in memory 15*a* in the ACS print mode will be explained. This operation is realized by the processing program 14*f* stored in the control unit 14*a* of the system unit 14 cooperating with the hardware by referring to data stored in the image data memory unit 15 and data stored in the RAM 14*d*.

Figure 4A:
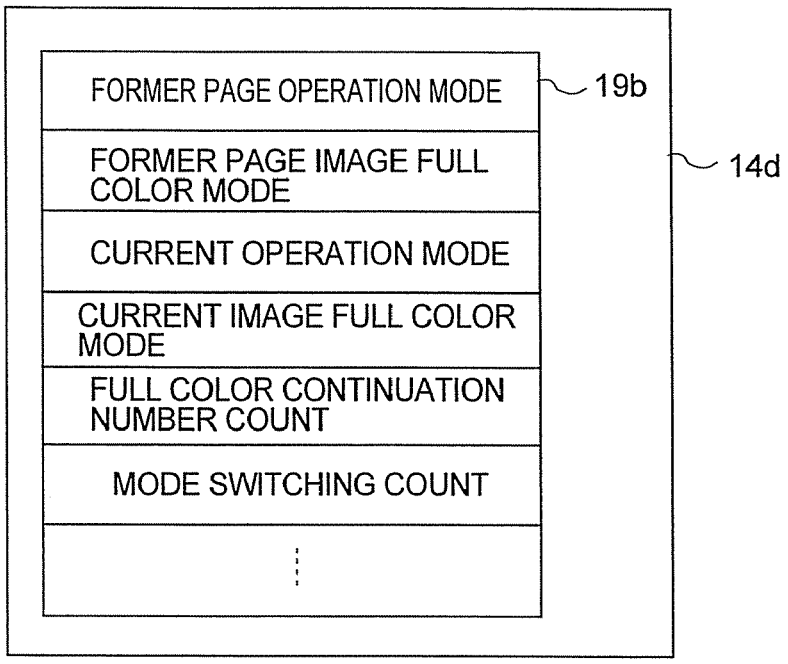
FIG. 4A is a data table stored in the RAM.
Figure 4B:
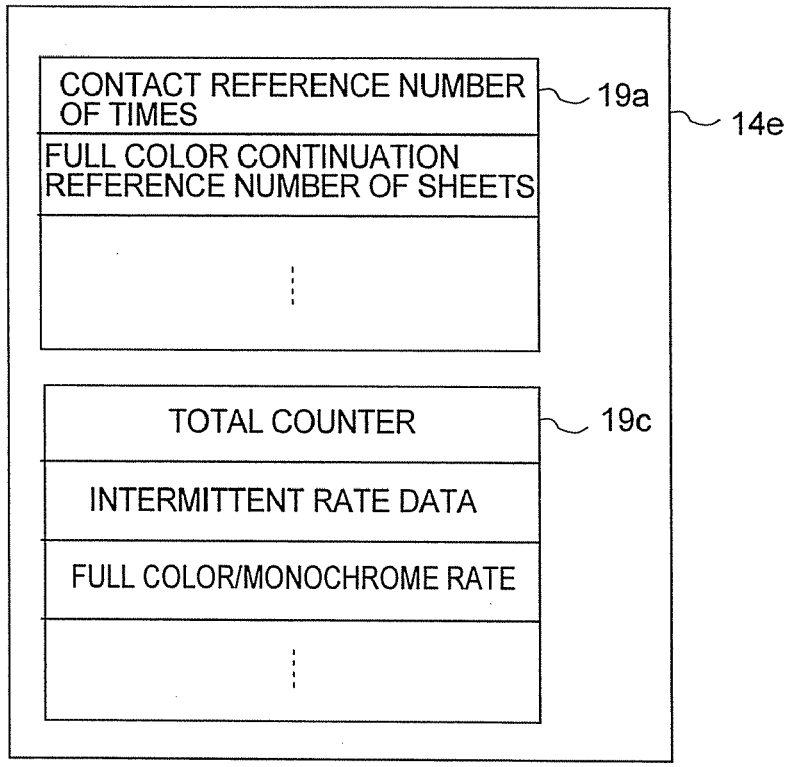
FIG. 4B is a data table stored in the NVRAM.

FIG. 4 shows drawings showing the contents of the data table stored in the RAM. In the RAM 14*d*, a control table 19*b* is installed. In the NVRAM 14*e*, a reference value table 19*a* and an actual value table 19*c* are installed. In the reference value table 19*a*, the reference value for deciding either of the operation modes such as the separation mode and contact mode is stored. The "contact reference number of times" is a reference value of the number of switching times from the separation mode to the contact mode in the concerned job. The "full color continuation reference number" is a reference value of the number of sheets when a full color image is printed continuously.

In the control table 19*b*, temporary data for deciding the operation mode is stored. The "former page operation mode" indicates the operation mode (the separation mode or contact mode) used to print the preceding page. The "former page image full color mode" indicates that the full color mode of the preceding page, that is, the image of the preceding page is a monochromatic image or a full color image. The "current operation mode" and "current image full color mode" indicate similarly the operation mode and full color mode of an image processed this time. The "full color continuation number count", when the images processed at present are full color images, indicates the sequential position of continuous full color images. The "mode switching count" indicates an integrated value of the number of switching times from the separation mode to the contact mode.

In the actual value table 19*c*, the data for deciding each reference value of the reference value table 19*a* is stored. The "total counter" indicates the total number of printed sheets per month. The "intermittent rate data" indicates the number of printed sheets (approximate data) per job. The "full color/monochrome rate" indicates a rate of the number of sheets of full color images processed to the number of sheets of monochromatic images.

Figure 5:
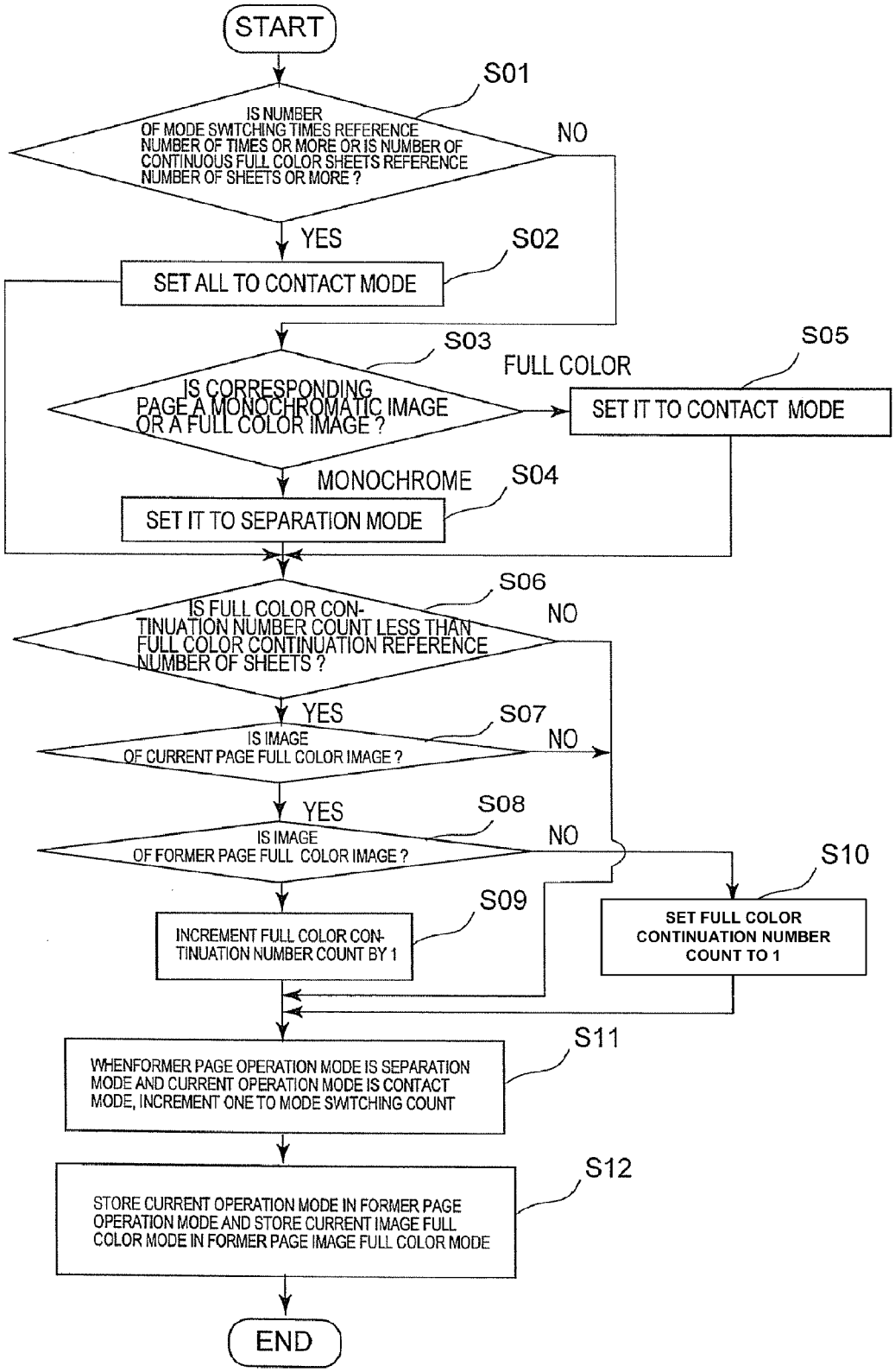
FIG. 5 is a flow chart showing the processing procedures for deciding the print mode.

FIG. 5 is a flow chart showing the processing procedures for deciding the operation mode. The procedures are used when printing the images of the ACS job stored in the built-in memory 15 which are obtained via a scanner or a network. Particularly, the procedures are applied when reading an image, deciding the print operation mode of the concerned page, thereby printing sequentially. Further, this processing, as mentioned above, is executed by the processing program 14*f* stored in the control unit 14*a* of the system unit 14 and hereinafter, the processing function will be explained at each step by referring to FIG. 3B.

At Step S01, the threshold value judging unit 31, from the actual results of the page printed already in the concerned job, judges which of the two conditions indicated below is applicable.

(1) The total number of switching times from the separation mode to the contact mode is the "contact reference number of times" shown in the reference value table 19*a* or more.

(2) Among the pages printed in the concerned job, the number of sheets of continuous full color images is the "full color continuation reference number of sheets" shown in the reference value table 19*a* or more.

When YES is applicable at Step S01, that is, when at least one of the two conditions is satisfied, at Step S02, the contact mode setting unit 32 sets the "current operation mode" shown in the control table 19*b* to the contact mode. On the other hand, when NO is applicable at Step S01, that is, when both of the two conditions are not satisfied, at Step S03, the contact mode setting unit 32 judges whether the concerned page is a monochromatic image or a full color image. In the judgement at Step S03, the operation mode setting unit 33, when the current page is a monochromatic image, sets the "current operation mode" to the separation mode (S04). When the current page is a full color image, the operation mode setting unit 33 sets the "current operation mode" to the contact mode (S05).

Next, at Step S06, the full color continuation number of sheets judging unit 34 judges whether the "full color continuation number count" shown in the control table 19*b* is less than the "full color continuation reference number of sheets" shown in the reference value table 19*a* or not. When YES is applicable at Step S06, at Step S07, the image full color mode judging unit 35 judges whether the image of the current page is a full color image or not.

When YES is applicable at Step S07, that is, when the image of the current page is a full color image, at Step S08, the full color number of sheets count-up unit 36 checks for the "former page image full color mode" shown in the control table 19*b*. If the image of the former page is also a full color image, the full color number of sheets count-up unit 36 increments 1 to the "full color continuation number count" (S09). If the image of the former page is not a full color image, the full color number of sheets count-up unit 36 sets 1 of an initial value in the "full color continuation number count" (S10).

When NO is applicable at Step S06 or when NO is applicable at Step S07, the full color number of sheets count-up unit 36 does not execute the aforementioned processes at Steps S08 to S10 and goes to the next step S11.

At Step S11, the number of contact times count-up unit 37, when the "former page operation mode" shown in the control table 19*b* is the separation mode and the "current operation mode" is the contact mode, increments one to the "mode switching count". At Step S12, the former condition keeping unit 38, to judge the operation mode of the next page, stores the information of the "current operation mode" in the "former page operation mode" and stores the information of the "current image full color mode" in the "former page image full color mode".

Next, an operation example for deciding the operation mode according to the flow chart shown in FIG. 5 will be explained.

OPERATION EXAMPLE 1

In the ACS job, 6 sheets of a monochromatic image, a full color image, a monochromatic image, a full color image, a monochromatic image, and a full color image are printed sequentially. The print operation when the contact reference number of times is 2 times and the full color continuation reference number of sheets is 2 sheets will be explained below.

At start time of the job, the "former page operation mode" shown in the control table 19*b* is set to the "separation mode" and the "former page image full color mode" is set to "monochromatic". Further, the "full color continuation number count" is set to "0" and the "mode switching count" is set to "0".

When printing the monochromatic image on the first page in the ACS job, the "mode switching count" is kept at "0" and the "full color continuation number count" is kept also at "0". Therefore, in the condition decision at Step S01, both the "mode switching count" and "full color continuation number count" are less than the respective reference values, so that "NO" is applicable.

At Step S03, the first page is a monochromatic image, so that the "current operation mode" is set to the "separation mode" (S04). In the condition decision at Step S06, the "full color continuation number count" is "0" and the "full color continuation reference number of sheets" is less than "2", so that YES is applicable and the process goes to Step S07. In the condition decision at Step S07, the "former page image full color mode" is "monochromatic", so that "NO" is applicable and the process goes to Step S11.

At Step S11, the "former page operation mode" is the "separation mode" and the "current operation mode" is also the "separation mode", so that nothing is done. At Step S12, to the "former page operation mode", the "separation mode" which is the "current operation mode" is set and to the "former page image full color mode", the "monochromatic" which is the "current image full color mode" is set.

The first page notifies the control unit 12*a* of the image forming unit 12 of the "separation mode" which is the "current operation mode" judged by the aforementioned process and forms an image in the operation state in the separation mode shown in FIG. 2.

When printing the full color image on the second page in the ACS job, the "mode switching count" is kept at "0" and the "full color continuation number count" is kept also at "0". Therefore, in the condition decision at Step S01, both the "mode switching count" and "full color continuation number count" are less than the respective reference values, so that "NO" is applicable.

At Step S03, the second page is a full color image, so that the "current operation mode" is set to the "contact mode" (S05). In the condition decision at Step S06, the "full color continuation number count" is "0" and the "full color continuation reference number of sheets" is less than "2", so that YES is applicable and the process goes to Step S07. In the condition decision at Step S07, the "current image full color mode" is "full color", so that "YES" is applicable and the process goes to Step S08.

At Step S08, the "former page image full color mode" is "monochromatic", so that the "full color continuation number count" is set to "1" (S10). At Step S11, the "former page operation mode" is the "separation mode" and the "current operation mode" is the "contact mode", so that "1" is incremented to the "mode switching count", thus the "mode switching count" is set to 1. At Step S12, to the "former page operation mode", the "contact mode" which is the "current operation mode" is set and to the "former page image full color mode", the "full color" which is the "current image full color mode" is set.

The second page notifies the control unit 12*a* of the image forming unit 12 of the "contact mode" which is the "current operation mode" judged by the aforementioned process and forms an image in the operation state in the contact mode shown in FIG. 1.

When printing the monochromatic image on the third page in the ACS job, the "mode switching count" is "1", and the "contact reference number of times" is less than "2", and the "full color continuation number count" is "1", and the "full color continuation reference number of sheets" is less than "2". Therefore, in the condition decision at Step S01, both the "mode switching count" and "full color continuation number count" are less than the respective reference values, so that "NO" is applicable.

At Step S03, the third page is a monochromatic image, so that the "current operation mode" is set to the "separation mode" (S04). In the condition decision at Step S06, the "full color continuation number count" is "1" and the "full color continuation reference number of sheets" is less than "2", so that YES is applicable and the process goes to Step S07. In the condition decision at Step S07, the "current image full color mode" is "monochromatic", so that "NO" is applicable and the process goes to Step S11.

At Step S11, the "former page operation mode" is the "contact mode" and the "current operation mode" is the "separation mode", so that nothing is done. At Step S12, to the "former page operation mode", the "separation mode" which is the "current operation mode" is set and to the "former page image full color mode", the "monochromatic" which is the "current image full color mode" is set.

The third page notifies the control unit 12*a* of the image forming unit 12 of the "separation mode" which is the "current operation mode" judged by the aforementioned process and forms an image in the operation state in the separation mode shown in FIG. 2.

When printing the full color image on the fourth page in the ACS job, the "mode switching count" is "1", and the "contact reference number of times" is less than "2", and the "full color continuation number count" is "1", and the "full color continuation reference number of sheets" is less than "2". Therefore, in the condition decision at Step S01, both the "mode switching count" and "full color continuation number count" are less than the respective reference values, so that "NO" is applicable.

At Step S03, the fourth page is a full color image, so that the "current operation mode" is set to the "contact mode" (S05). In the condition decision at Step S06, the "full color continuation number count" is "1" and the "full color continuation reference number of sheets" is less than "2", so that "YES" is applicable and the process goes to Step S07. In the condition decision at Step S07, the "current image full color mode" is "monochromatic", so that "YES" is applicable and the process goes to Step S08.

At Step S08, the "former page image full color mode" is "monochromatic", so that the "full color continuation number count" is set to "1" (S10). At Step S11, the "former page operation mode" is the "separation mode" and the "current operation mode" is the "contact mode", so that "1" is incremented to the "mode switching count", thus the "mode switching count" is set to 2. At Step S12, to the "former page operation mode", the "contact mode" which is the "current operation mode" is set and to the "former page image full color mode", the "full color" which is the "current image full color mode" is set.

The fourth page notifies the control unit 12*a* of the image forming unit 12 of the "contact mode" which is the "current operation mode" judged by the aforementioned process and forms an image in the operation state in the contact mode shown in FIG. 1.

When printing the monochromatic image on the fifth page in the ACS job, the "mode switching count" is "2" and the "contact reference number of times" is "2" or more. Therefore, in the condition decision at Step S01, "YES" is applicable and at Step S02, the "current operation mode" is set to the "contact mode".

In the condition decision at Step S06, the "full color continuation number count" is "1" and the "full color continuation reference number of sheets" is less than "2", so that "YES" is applicable and the process goes to Step S07. In the condition decision at Step S07, the "current image full color mode" is "monochromatic", so that "NO" is applicable and the process goes to Step S11.

At Step S11, the "former page operation mode" is the "contact mode" and the "current operation mode" is also the "contact mode", so that nothing is done. At Step S12, to the "former page operation mode", the "contact mode" which is the "current operation mode" is set and to the "former page image full color mode", the "monochromatic" which is the "current image full color mode" is set.

The fifth page notifies the control unit 12*a* of the image forming unit 12 of the "contact mode" which is the "current operation mode" judged by the aforementioned process and forms an image in the operation state in the contact mode shown in FIG. 1.

When printing the full color image on the sixth page in the ACS job, the "mode switching count" is "2" and the "contact reference number of times" is "2" or more. Therefore, in the condition decision at Step S01, "YES" is applicable and at Step S02, the "current operation mode" is set to the "contact mode".

In the condition decision at Step S06, the "full color continuation number count" is "1" and the "full color continuation reference number of sheets" is less than "2", so that "YES" is applicable and the process goes to Step S07. In the condition decision at Step S07, the "current image full color mode" is "full color", so that "YES" is applicable and the process goes to Step S09.

At Step S09, the "former page image full color mode" is "monochromatic", so that the "full color continuation number count" is set to "1". At Step S11, the "former page operation mode" is the "contact mode" and the "current operation mode" is the "contact mode", so that nothing is done. At Step S12, to the "former page operation mode", the "contact mode" which is the "current operation mode" is set and to the "former page image full color mode", the "full color" which is the "current image full color mode" is set.

The sixth page notifies the control unit 12*a* of the image forming unit 12 of the "contact mode" which is the "current operation mode" judged by the aforementioned process and forms an image in the operation state in the contact mode shown in FIG. 1.

When judging the operation mode as mentioned above, thereby printing an image, as compared with the case that for a monochromatic image, the operation is performed in the separation mode and for a full color image, the operation is performed in the contact mode, the performance can be improved. Conventionally, the switching operation time of five times in total such as three switching times from the separation mode to the contact mode and two switching times from the contact mode to the separation mode is necessary. On the other hand, this operation can be processed for the switching operation time of three times in total such as two switching times from the separation mode to the contact mode and one switching time from the contact mode to the separation mode.

OPERATION EXAMPLE 2

In the ACS job, 7 sheets of a monochromatic image, a full color image, a full color image, a monochromatic image, a full color image, a monochromatic image, and a full color image are printed sequentially. The print operation when the contact reference number of times is 2 times and the full color continuation reference number of sheets is 2 sheets will be explained below.

At start time of the job, the "former page operation mode" shown in the control table 19*b* is set to the "separation mode" and the "former page image full color mode" is set to "monochromatic". Further, the "full color continuation number count" is set to "0" and the "mode switching count" is set to "0".

When printing the monochromatic image on the first page in the ACS job, the "mode switching count" is kept at "0" and the "full color continuation number count" is kept also at "0". Therefore, in the condition decision at Step S01, both the "mode switching count" and "full color continuation number count" are less than the respective reference values, so that "NO" is applicable.

At Step S03, the first page is a monochromatic image, so that the "current operation mode" is set to the "separation mode" (S04). In the condition decision at Step S06, the "full color continuation number count" is "0" and the "full color continuation reference number of sheets" is less than "2", so that YES is applicable and the process goes to Step S07. In the condition decision at Step S07, the "current page image full color mode" is "monochromatic", so that "NO" is applicable and the process goes to Step S11.

At Step S11, the "former page operation mode" is the "separation mode" and the "current operation mode" is also the "separation mode", so that nothing is done. At Step S12, to the "former page operation mode", the "separation mode" which is the "current operation mode" is set and to the "former page image full color mode", the "monochromatic" which is the "current image full color mode" is set.

The first page notifies the control unit 12*a* of the image forming unit 12 of the "separation mode" which is the "current operation mode" judged by the aforementioned process and forms an image in the operation state in the separation mode shown in FIG. 2.

When printing the full color image on the second page in the ACS job, the "mode switching count" is kept at "0" and the "full color continuation number count" is kept also at "0". Therefore, in the condition decision at Step S01, both the "mode switching count" and "full color continuation number count" are less than the respective reference values, so that "NO" is applicable.

At Step S03, the second page is a full color image, so that the "current operation mode" is set to the "contact mode" (S05). In the condition decision at Step S06, the "full color continuation number count" is "0" and the "full color continuation reference number of sheets" is less than "2", so that YES is applicable and the process goes to Step S07. In the condition decision at Step S07, the "current image full color mode" is "full color", so that "YES" is applicable and the process goes to Step S08.

At Step S08, the "former page image full color mode" is "monochromatic", so that the "full color continuation number count" is set to "1" (S10). At Step S11, the "former page operation mode" is the "separation mode" and the "current operation mode" is the "contact mode", so that "1" is incremented to the "mode switching count", thus the "mode switching count" is set to 1. At Step S12, to the "former page operation mode", the "contact mode" which is the "current operation mode" is set and to the "former page image full color mode", the "full color" which is the "current image full color mode" is set.

The second page notifies the control unit 12*a* of the image forming unit 12 of the "contact mode" which is the "current operation mode" judged by the aforementioned process and forms an image in the operation state in the contact mode shown in FIG. 1.

When printing the full color image on the third page in the ACS job, the "mode switching count" is "1", and the "contact reference number of times" is less than "2", and the "full color continuation number count" is "1", and the "full color continuation reference number of sheets" is less than "2". Therefore, in the condition decision at Step S01, both the "mode switching count" and "full color continuation number count" are less than the respective reference values, so that "NO" is applicable.

At Step S03, the fourth page is a full color image, so that the "current operation mode" is set to the "contact mode" (S05). In the condition decision at Step S06, the "full color continuation number count" is "1" and the "full color continuation reference number of sheets" is less than "2", so that YES is applicable and the process goes to Step S07. In the condition decision at Step S07, the "current image full color mode" is "full color", so that "YES" is applicable and the process goes to Step S08.

The condition decision at Step S08 is "full color", so that "1" is incremented to the "full color continuation number count" and the "full color continuation number count" is set to "2". At Step S11, the "former page operation mode" is the "contact mode" and the "current operation mode" is also the "contact mode", so that nothing is done. At Step S12, to the "former page operation mode", the "contact mode" which is the "current operation mode" is set and to the "former page image full color mode", the "full color" which is the "current image full color mode" is set.

The third page notifies the control unit 12*a* of the image forming unit 12 of the "contact mode" which is the "current operation mode" judged by the aforementioned process and forms an image in the operation state in the contact mode shown in FIG. 1.

When printing the monochromatic image on the fourth page in the ACS job, the "mode switching count" is "1" and the "contact reference number of times" is less than "2". However, the "full color continuation number count" is "2" and the "full color continuation reference number of sheets" is "2" or more, so that "YES" is applicable. Therefore, in the condition decision at Step S01, "YES" is applicable and at Step S02, the "current operation mode" is set to the "contact mode".

In the condition decision at Step S06, the "full color continuation number count" is "2" and the "full color continuation reference number of sheets" is "2" or more, so that "NO" is applicable and the process goes to Step S11. At Step S11, the "former page operation mode" is the "contact mode" and the "current operation mode" is also the "contact mode", so that nothing is done. At Step S12, to the "former page operation mode", the "contact mode" which is the "current operation mode" is set and to the "former page image full color mode", the "monochromatic" which is the "current image full color mode" is set.

The fourth page notifies the control unit 12*a* of the image forming unit 12 of the "contact mode" which is the "current operation mode" judged by the aforementioned process and forms an image in the operation state in the contact mode shown in FIG. 1.

When printing the full color image on the fifth page in the ACS job, the "mode switching count" is "1" and the "contact reference number of times" is less than "2". However, the "full color continuation number count" is "2" and the "full color continuation reference number of sheets" is "2" or more, so that "YES" is applicable. Therefore, in the condition decision at Step S01, "YES" is applicable and at Step S02, the "current operation mode" is set to the "contact mode".

In the condition decision at Step S06, the "full color continuation number count" is "2" and the "full color continuation reference number of sheets" is "2" or more, so that "NO" is applicable and the process goes to Step S11. At Step S11, the "former page operation mode" is the "contact mode" and the "current operation mode" is also the "contact mode", so that nothing is done. At Step S12, to the "former page operation mode", the "contact mode" which is the "current operation mode" is set and to the "former page image full color mode", the "full color" which is the "current image full color mode" is set.

The fifth page notifies the control unit 12*a* of the image forming unit 12 of the "contact mode" which is the "current operation mode" judged by the aforementioned process and forms an image in the operation state in the contact mode shown in FIG. 1.

When printing the monochromatic image on the sixth page in the ACS job, the "mode switching count" is "1" and the "contact reference number of times" is less than "2". However, the "full color continuation number count" is "2" and the "full color continuation reference number of sheets" is "2" or more, so that "YES" is applicable. Therefore, in the condition decision at Step S01, "YES" is applicable and at Step S02, the "current operation mode" is set to the "contact mode".

In the condition decision at Step S06, the "full color continuation number count" is "2" and the "full color continuation reference number of sheets" is "2" or more, so that "NO" is applicable and the process goes to Step S11. At Step S11, the "former page operation mode" is the "contact mode" and the "current operation mode" is also the "contact mode", so that nothing is done. At Step S12, to the "former page operation mode", the "contact mode" which is the "current operation mode" is set and to the "former page image full color mode", the "monochromatic" which is the "current image full color mode" is set.

The sixth page notifies the control unit 12*a* of the image forming unit 12 of the "contact mode" which is the "current operation mode" judged by the aforementioned process and forms an image in the operation state in the contact mode shown in FIG. 1.

When printing the full color image on the seventh page in the ACS job, the "mode switching count" is "1" and the "contact reference number of times" is less than "2". However, the "full color continuation number count" is "2" and the "full color continuation reference number of sheets" is "2" or more, so that "YES" is applicable. Therefore, in the condition decision at Step S01, "YES" is applicable and at Step S02, the "current operation mode" is set to the "contact mode".

In the condition decision at Step S06, the "full color continuation number count" is "2" and the "full color continuation reference number of sheets" is "2" or more, so that "NO" is applicable and the process goes to Step S11. At Step S11, the "former page operation mode" is the "contact mode" and the "current operation mode" is also the "contact mode", so that nothing is done. At Step S12, to the "former page operation mode", the "contact mode" which is the "current operation mode" is set and to the "former page image full color mode", the "full color" which is the "current image full color mode" is set.

The seventh page notifies the control unit 12*a* of the image forming unit 12 of the "contact mode" which is the "current operation mode" judged by the aforementioned process and forms an image in the operation state in the contact mode shown in FIG. 1.

When judging the operation mode as mentioned above, thereby printing an image, as compared with the case that for a monochromatic image, the operation is performed in the separation mode and for a full color image, the operation is performed in the contact mode, the performance can be improved. Conventionally, the switching operation time of five times in total such as three switching times from the separation mode to the contact mode and two switching times from the contact mode to the separation mode is necessary. On the other hand, this operation can be processed for the switching operation time of one time in total such as one switching time from the separation mode to the contact mode and zero switching times from the contact mode to the separation mode.

Then, a method for setting the "contact reference number of times" and "full color continuation reference number of sheets" which are important reference values when performing the aforementioned processes will be explained. The values of the "contact reference number of times" and "full color continuation reference number of sheets" are decided by a maintenance man who refers periodically to the use actual result data of the image forming apparatus 10. As use actual result data, the "total counter", "intermittent rate data", and "full color/monochrome rate" are provided. The maintenance man displays and confirms properly these values on the display/operation unit 16 and can change them.

The "total counter" means a print volume per month, that is, the total number of printed sheets per month. When the "total counter" is very few, the "contact reference number of times" and "full color continuation reference number of sheets" are set low. Since the print volume per month is very few, it can be inferred that the number of printed sheets per job is also very few. Under this control, when printing so that either of the "contact reference number of times" and "full color continuation reference number of sheets" reaches the reference value or more, a predetermined effect can be obtained. Therefore, When the "total counter" is very few, it is preferable to change the reference value to a smaller value so as to obtain an effect. Further, when printing a small amount, the ratio of the idling time of the drum at time of switching to the printing time becomes larger, so that it is highly probable that expendables may be deteriorated due to the idling time generated by switching. In the sense of preventing expendables from shortening of the life span, it is preferable to change the reference value to a smaller value.

The "intermittent rate data" is data for indicating how much the number of printed sheets per job is. The data cannot be seen ordinarily by a user but can be seen by special setting by a service man. However, it is difficult to calculate a perfect intermittent rate, so that actually, the intermittent rate data is approximate data. When the "intermittent rate data" is very little, the reference number of times and reference number of sheets are set low. When the intermittent rate is low, that is, the number of printed sheets per job is very few, for the same reason as that when the aforementioned print volume per month is very few, to obtain an effect under this control, it is preferable to change the reference value to a smaller value.

The "full color/monochrome rate" is data for indicating the ratio of full color print to monochrome print. The data may be a value calculated from a full color counter value and a monochromatic counter value for billing. Further, it may be calculated using an expendable drive counter for confirming the life of the expendables, for example, the time for driving the photosensitive drum 21Y for yellow image formation and the time for driving the photosensitive drum 21K for black image formation. When the "full color/monochrome rate" is low, that is, when the ratio of the monochrome is high, the reference number of times and reference number of sheets are set high. When the ratio of the monochrome is high, the frequency of performing of the monochrome print in the contact mode is increased and it becomes highly possible that the life of the expendables is deteriorated. Therefore, it is preferable to change the reference value to a large value.

Further, these reference values may be set by the maintenance man or an optimum reference value may be calculated and set automatically by the image forming apparatus 10.

(Effects of this embodiment) When printing a mixture of a monochromatic image and a full color image in the ACS mode, it is desired to solve the two problems such as improvement of the performance and prevention of shortening of the life spans of the expendables. These two problems are basically contrary to each other and it is difficult to satisfy both problems perfectly. Therefore, in the conventional control, control that emphasis is put on the solution of either of them is adopted. On the basis of Condition 1 and Condition 2 aforementioned, the operation mode is decided.

Condition 1 and Condition 2, even if judged only under either of the conditions, may be considered to obtain some effects. However, when the two conditions are ORed with each other, more appropriate control is enabled. For example, under only Condition 1, in a job that there are mostly full color pages provided and several monochromatic pages are inserted between them, to switch the several monochromatic pages inserted between them to the separation mode, by the factors that the performance is lowered and the life is deteriorated due to idling, the life preferential effects are reduced. However, when Condition 2 is provided as an OR condition, it can be switched to the contact mode and optimum control is enabled. Further, if it is set to the OR condition, by making either of the condition judgements strict, judgement under only the other condition, that is, judgement under a single condition is enabled.

Furthermore, in this embodiment, every reading an image on the basis of the previous actual values in the same job, Condition 1 and Condition 2 are judged in real time. Therefore, as compared with the case that all jobs are read and the operation mode is decided, a user does not need to wait and the performance is excellent.

Further, in the embodiment aforementioned, the number of switching times from the separation mode to the contact mode is set as a condition, though the number of switching times from the contact mode to the separation mode may be set as a condition. However, the case that the number of switching times from the separation mode to the contact mode is set as a condition has an advantage that the number of switching times can be reduced.

As mentioned above, according this embodiment, the following effect can be obtained. The two problems of the print performance and mechanical life are made compatible with each other and particularly control free of impairment of the print performance is enabled. The mode is judged from the information of previous performance of printing, so that even a print mode of printing sequentially by inputting can be judged appropriately. When an image is judged once as a contact mode, the subsequent monochromatic images are all operated in the contact mode, so that the possibility that the print performance may be lowered due to switching of the mode depending of the subsequent images can be eliminated. The two conditions are ORed, so that control free of more impairment of the performance is enabled.

Further, each function explained in the embodiment aforementioned may be formed using hardware and may be realized by reading the program for recording each function using software into a computer. Further, each function may be formed by selecting properly either of the software and hardware.

Furthermore, each function can be realized by reading the program stored in a recording medium not drawn into a computer. Here, if the recording medium of this embodiment is a recording medium which can record a program and can be read by a computer, the recording form thereof is no particular object.

Further, the present invention is not limited straight to the embodiments aforementioned and at the execution stage, within a range which is not deviated from the objects thereof, the components can be modified and concretized. Further, by an appropriate combination of a plurality of components disclosed in the embodiments aforementioned, various inventions can be formed. For example, from all the components shown in the embodiments, some components may be deleted. Furthermore, the components extending over different embodiments may be combined properly.

According to the image forming apparatus, image forming method, and program of the present invention, the apparatus avoids a reduction in the life span thereof and the print performance can be improved.

What is claimed is:

1. An image forming apparatus including a separation mode for permitting a transfer medium, at time of a monochrome print, to make contact with only a monochrome image forming unit and separating the transfer medium from a plurality of remaining image forming units and a contact mode for permitting the transfer medium to make contact with all the plurality of image forming units and enabling the modes to be switched, comprising:

judging means for judging, based on image information, whether an image to be printed is a monochromatic image or a full color image;

operation mode deciding means for deciding which mode is used to print the image, the contact mode or the separation mode;

printing means for printing the image in the decided mode, the operation mode deciding means, at the beginning of a job, deciding the separation mode for the monochromatic image and the contact mode for the full color image and after a predetermined condition being satisfied on the basis of actual results of the page printed already in the job, deciding the contact mode for both monochromatic images and full color images; and setting means for setting a reference value for judging success or failure of the predetermined condition.

2. The apparatus according to claim 1, wherein the predetermined condition is that from the actual results of the page printed already in the job, the total number of switching times from either of the contact mode and separation mode to another one is the reference number of times or more or the number of sheets of continuous full color images is the reference number of sheets or more.

3. The apparatus according to claim 1, wherein the predetermined condition is that from the actual results of the page printed already in the job, the total number of switching times from the separation mode to the contact mode is the reference number of times or more or the number of sheets of continuous full color images is the reference number of sheets or more.

4. The apparatus according to claim 1, wherein the predetermined condition is that from the actual results of the page printed already in the job, the total number of switching times from the separation mode to the contact mode is the reference number of times or more.

5. The apparatus according to claim 1, wherein the predetermined condition is that from the actual results of the page printed already in the job, the number of sheets of continuous full color images is the reference number of sheets or more.

6. The apparatus according to claim 1, a color of the monochrome print being black.

7. An image forming method for an image forming apparatus including a separation mode for permitting, at time of a monochrome print, a monochromatic image forming unit to make contact with a transfer medium and permitting image forming units of other colors to separate from the transfer medium to execute printing and a contact mode for permitting the image forming units of all the colors to make contact with the transfer medium to execute printing for enabling the aforementioned modes to be switched, comprising:

judging, on the basis of image information, whether an image to be printed is a monochrome image or a full color image;

deciding, at the beginning of a job, the separation mode for the monochromatic image and the contact mode for the full color image;

deciding, after a predetermined condition is satisfied on the basis of the actual results of the page printed already in the job, the contact mode for both monochromatic images and full color images;

setting a reference value for judging success or failure of the predetermined condition; and printing the images in the decided mode.

8. The method according to claim 7, the predetermined condition being that from the actual results of the page printed already in the job, the total number of switching times from either of the contact mode and separation mode to another one being the reference number of times or more or the number of sheets of continuous full color images being the reference number of sheets or more.

9. The method according to claim 7, the predetermined condition being that from the actual results of the page printed already in the job, the total number of switching times from the separation mode to the contact mode being the reference number of times or more or the number of sheets of continuous full color images being the reference number of sheets or more.

10. The method according to claim 7, the predetermined condition being that from the actual results of the page printed already in the job, the total number of switching times from the separation mode to the contact mode being the reference number of times or more.

11. The method according to claim 7, the predetermined condition is that from the actual results of the page printed already in the job, the number of sheets of continuous full color images being the reference number of sheets or more.

12. The method according to claim 7, a color of the monochrome print being black.

13. An image forming apparatus including a separation mode to permit a transfer medium, at time of monochrome print, to make contact with only a monochromatic image forming unit and separating it from a plurality of remaining image forming units and a contact mode to permit the transfer medium to make contact with all the plurality of image forming units and enabling the aforementioned modes to be switched, comprising a judging unit configured to judge, on the basis of image information, whether an image to be printed is a monochromatic image or a full color image;

an operation mode deciding unit configured to decide which mode is used to print the image, the contact mode or the separation mode; and a printing unit configured to print the image in the decided mode, wherein:

the operation mode deciding unit, at the beginning of a job, deciding the separation mode for the monochromatic image and the contact mode for the full color image and after a predetermined condition being satisfied on the basis of actual results of the page printed already in the job, deciding the contact mode for both monochromatic images and full color images; and a setting unit for setting a reference value for judging success or failure of the predetermined condition.

14. The apparatus according to claim 13, the predetermined condition being that from the actual results of the page printed already in the job, the total number of switching times from either of the contact mode and separation mode to another one being the reference number of times or more or the number of sheets of continuous full color images being the reference number of sheets or more.

15. The apparatus according to claim 13, the predetermined condition being that from the actual results of the page printed already in the job, the total number of switching times from the separation mode to the contact mode being the reference number of times or more or the number of sheets of continuous full color images being the reference number of sheets or more.

16. The apparatus according to claim 13, the predetermined condition being that from the actual results of the page printed already in the job, the total number of switching times from the separation mode to the contact mode being the reference number of times or more.

17. The apparatus according to claim 13, the predetermined condition being that from the actual results of the page printed already in the job, the number of sheets of continuous full color images being the reference number of sheets or more.

18. The apparatus according to claim 13, a color of the monochrome print being black.

* * * * *